US007917069B2

(12) United States Patent
Sakamaki

(10) Patent No.: US 7,917,069 B2
(45) Date of Patent: Mar. 29, 2011

(54) DEVELOPMENT APPARATUS INCLUDING A FIRST DEVELOPER MEMBER MADE OF PURE ALUMINUM OR AN ALUMINUM ALLOY AND A SECOND DEVELOPER MEMBER OF STAINLESS STEEL

(75) Inventor: Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 12/018,488

(22) Filed: Jan. 23, 2008

(65) Prior Publication Data

US 2008/0181679 A1 Jul. 31, 2008

(30) Foreign Application Priority Data

Jan. 30, 2007 (JP) ..... 2007-018723

(51) Int. Cl.
*G03G 15/08* (2006.01)

(52) U.S. Cl. ..... 399/286

(58) Field of Classification Search ..... 399/286, 399/269

See application file for complete search history.

(56) References Cited

U.S. PATENT DOCUMENTS

| | | | | |
|---|---|---|---|---|
| 6,973,281 | B2 | 12/2005 | Hirobe et al. | |
| 6,975,825 | B2 | 12/2005 | Sakamaki et al. | |
| 6,978,108 | B2 | 12/2005 | Sakamaki | |
| 7,099,609 | B2 | 8/2006 | Hirobe et al. | |
| 2004/0037594 | A1* | 2/2004 | Sakamaki et al. | 399/269 |
| 2006/0222416 | A1* | 10/2006 | Kurogawa et al. | 399/269 |
| 2007/0053725 | A1 | 3/2007 | Sakamaki et al. | |
| 2007/0231018 | A1* | 10/2007 | Kumar et al. | 399/269 |

FOREIGN PATENT DOCUMENTS

| | | | |
|---|---|---|---|
| CN | 1474238 | A | 2/2004 |
| CN | 1507583 | A | 6/2004 |
| JP | 9-106188 | A | 4/1997 |
| JP | 2699968 | B2 | 9/1997 |

OTHER PUBLICATIONS

Notification of the Second Office Action dated Jan. 29, 2010, in counterpart Chinese Application No. 200810004470.X.

* cited by examiner

*Primary Examiner* — David M Gray
*Assistant Examiner* — Billy J Lactaoen
(74) *Attorney, Agent, or Firm* — Fitzpatrick, Cella, Harper & Scinto

(57) ABSTRACT

A development apparatus includes a first base member which bears and conveys a developer and which develops an electrostatic image in a first developing region, a restriction member which restricts a layer thickness of the developer borne by the first basemember, and a second base member which bears and conveys the developer received from the first basemember, and which develops the electrostatic image in a second developing region, the first base member is made of pure aluminum or aluminum alloy, and the second base member is made of stainless steel.

3 Claims, 7 Drawing Sheets

DEVELOPMENT APPARATUS INCLUDING A FIRST DEVELOPER MEMBER MADE OF PURE ALUMINUM OR AN ALUMINUM ALLOY AND A SECOND DEVELOPER MEMBER OF STAINLESS STEEL

BACKGROUND OF THE INVENTION

1. Field of the Invention

The present invention relates to a development apparatus used for forming an image using an electrophotographic system or an electrostatic recording system, and more particularly, to a development apparatus having a plurality of developer bearing members.

2. Description of the Related Art

In an image forming apparatus, such as an electrophotographic copying machine, a magnetic brush developing method using a developing sleeve which is a developer bearing member is generally used. The magnetic brush developing method will be described below.

First, to efficiently develop an electrostatic image on a photosensitive drum, binary-component developer or one-component developer is held by a developing sleeve. The developing sleeve is a hollow cylindrical developer bearing member made of non-magnetic body having a magnetic pole therein.

Next, developer is conveyed from a developer container to a developing region opposed to the photosensitive drum. Developer is an ear of magnetic developer in the developing region by effect of a magnetic field, the developer slides on a photosensitive drum surface, thereby developing an electrostatic latent image formed on the photosensitive drum.

The magnetic brush developing method using the developing sleeve is used in many products, such as a monochrome digital copying machine and a full-color copying machine requiring high image quality.

When rotation moving speed of the photosensitive drum is relatively low, i.e., in the case of a relatively low speed copying machine, since an excellent developed image is obtained even if developing time is short, one developing sleeve is sufficient. However, when the rotation moving speed of the photosensitive drum is increased due to high speed demand of recent copying machine, an excellent image is not always formed using one developing sleeve.

As a countermeasure for this, there is a method for enhancing the developing efficiency by increasing the circumferential velocity of the developing sleeve. However, if the circumferential velocity of the developing sleeve is increased, a centrifugal force acting on the developer which forms a magnetic brush is increased, scatter of developer is increased, the inside of the copying machine is contaminated, and there is an adverse possibility that the function of the apparatus is deteriorated.

As another countermeasure, there is proposed a so-called multi-magnetic brush developing method in which two or more developing sleeves are used, they are disposed such that peripheral surfaces thereof are close and adjacent to each other, developer is conveyed such that the developer runs over the peripheral surfaces, the developing time is increased, and developing ability is enhanced (see Japanese Patent No. 02699968).

In the multi-magnetic brush developing type development apparatus having two or more developing sleeves, there is a well known development apparatus using either stainless steel (SUS) or aluminum as a material of base material of the developing sleeve.

However, the development apparatus using a stainless steel developing sleeve has the following problems.

Stainless steel has relatively high hardness and thus has excellent durability, but has a drawback in that thermal conductivity is poor. Therefore, if there is a heat source in the vicinity of the developing sleeve, a temperature difference is generated between the heat source side of the developing sleeve and the opposite side, and the developing sleeve is deformed by heat, so that developing density is varied in the rotation cycle of the developing sleeve in some cases.

As a countermeasure of this problem, there is proposed a method in which the developing sleeve is rotated little by little at certain time intervals during standby of the image forming apparatus, a copying operation is started after variation in the temperature distribution of the developing sleeve is reduced. However, this method has a problem that lifetime of a driving system of the developing sleeve is shortened and that developer is scattered.

There is a proposed method in which at the same time when a user pushes a copy button, the developing sleeve is rotated only during a certain period to eliminate the variation in temperature distribution of the developing sleeve, and then the copying operation is started. However, this method has a problem that the first copy time is increased. Therefore, it is necessary to make uniform the temperature distribution of the developing sleeve as much as possible.

The development apparatus using an aluminum developing sleeve has the following problem.

Contrary to stainless steel, aluminum has high thermal conductivity and is relatively soft. Therefore, satisfactory durability cannot be obtained in some cases.

SUMMARY OF THE INVENTION

The present invention is to provide a development apparatus using two or more base materials which bears developer, which is capable of suppressing thermal deformation which is caused due to unevenness of temperature distribution of the base materials, and capable of forming an image having no density variation or unevenness.

A development apparatus of the invention which develops, using a developer, an electrostatic image borne by an image bearing member, and comprises a first member which bears and conveys the developer to a first developing region opposed to the image bearing member, which develops the electrostatic image in a first region; a restriction member which restricts a layer thickness of the developer carried by the first member; and a second member which bears and conveys the developer received from the first member to a second developing region opposed to the image bearing member, which develops the electrostatic image in the second developing region, wherein the first member is made of pure aluminum or an aluminum alloy and the second member is made of stainless steel.

Further features of the present invention will become apparent from the following description of exemplary embodiments with reference to the attached drawings.

DESCRIPTION OF THE EMBODIMENTS

An image forming apparatus according to the present invention will be described in detail based on the drawings.

First Embodiment

Figure 1:
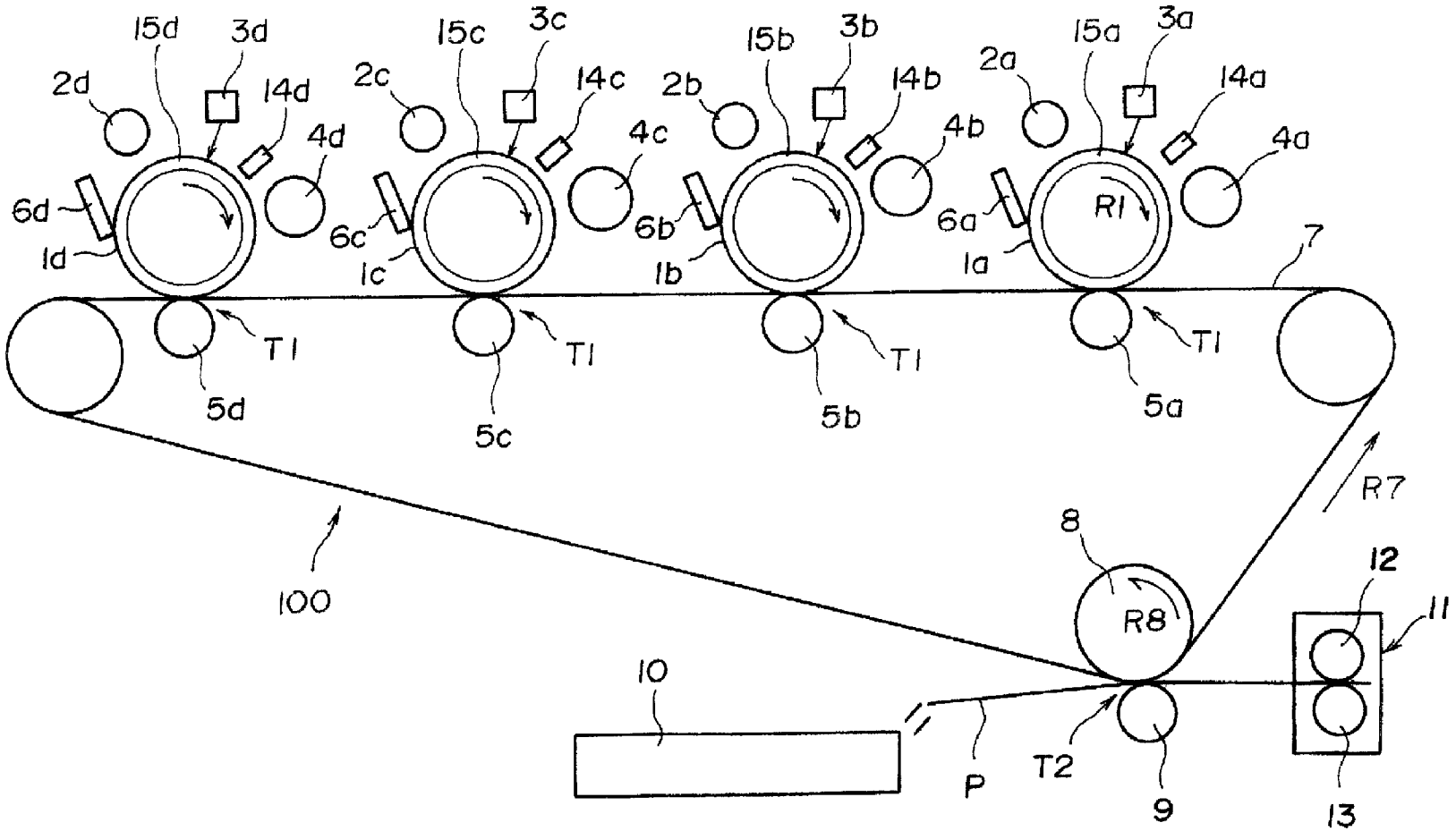
FIG. 1 is a diagram illustrating a structure of an image forming apparatus according to a first embodiment.

A first embodiment of the development apparatus of the present invention will be described using the drawings. FIG. 1 is a diagram illustrating a structure of an image forming apparatus according to the first embodiment. This embodiment is one mode to which the present invention can be applied, and the invention is not limited to this embodiment.

(Image Forming Apparatus 100)

As shown in FIG. 1, an image forming apparatus 100 is a four full-color electrophotographic system image forming apparatus having four image forming portions (image forming stations). The four image forming portions are disposed from upstream to downstream along a rotation direction (direction of arrow R7) of an intermediate transfer belt 7 as an intermediate transfer member.

Each image forming portion includes drum-shaped electrophotographic photosensitive members ("photosensitive drums", hereinafter) 1*a*, 1*b*, 1*c* and 1*d* as image bearing members. The photosensitive drums 1*a* to 1*d* form yellow, magenta, cyan and black toner image in this order.

The photosensitive drums 1*a* to 1*d* are rotated and driven in the direction of the arrow R1 (clockwise direction in FIG. 1). The photosensitive drums 1*a* to 1*d*, respectively, include heaters (heat sources) 15*a* to 15*d* therein. The photosensitive drums 1*a* to 1*d* are controlled such that temperature thereof is maintained at about 45□C based on detection results of the temperature detecting means 14*a*, 14*b*, 14*c* and 14*d* on the photosensitive drum. It is possible to use a thermopile type or thermistor type means as the temperature detecting means 14*a*, 14*b*, 14*c* and 14*d*.

A charger (charging means) 2, an exposure device (latent image forming means) 3, a development apparatus 4, a primary transfer roller (primary transfer means) 5 and a drum cleaner (cleaning device) 6 are disposed around each photosensitive drums 1*a* to 1*d* along a rotation direction thereof.

An endless intermediate transfer belt 7 is wound around the primary transfer rollers 5*a* to 5*d* and a secondary transfer counter roller 8. The intermediate transfer belt 7 is pressed by the primary transfer rollers 5*a* to 5*d* from its back side, and a surface of the intermediate transfer belt 7 is abutted against the photosensitive drums 1*a* to 1*d*. The intermediate transfer belt 7 rotates in the direction of the arrow R7 as the roller 8 which also functions as a driving roller rotates in the direction of the arrow R8. The rotation speed of the intermediate transfer belt 7 is substantially equal to the rotation speed (process speed) of each of the photosensitive drums 1*a* to 1*d*.

A secondary transfer roller (secondary transfer means) 9 is disposed on a surface of the intermediate transfer belt 7 at a location corresponding to the roller 8. The intermediate transfer belt 7 is held between the secondary transfer roller 9 and the roller 8. A secondary transfer nip (secondary transfer portion) T2 is formed between the secondary transfer roller 9 and the intermediate transfer belt 7.

Transfer materials P on which images are formed are stacked on a sheet cassette 10. The transfer materials P are supplied to the secondary transfer nip T2 by a conveying apparatus having a sheet roller, a conveying roller and a registration roller (not shown).

In the image forming apparatus having the above-described structure, a four full-color toner image is formed on the transfer material P in the following manner.

First, the photosensitive drums 1*a* to 1*d* are rotated and driven at a predetermined process speed in the direction of the arrow by a photosensitive drum driving motor (not shown), and are uniformly charged to a predetermined polarity and potential by chargers 2*a*, 2*b*, 2*c*, 2*d*. The charged photosensitive drums 1*a* to 1*d* are exposed to light based on image information by exposure devices 3*a*, 3*b*, 3*c*, 3*d*, and an electric charge at the exposed portion is eliminated and an electrostatic image of each color is formed.

Electrostatic images on the photosensitive drums 1*a* to 1*d* are developed as yellow, magenta, cyan, black toner images by the development apparatuses 4*a*, 4*b*, 4*c*, and 4*d*. These four color toner images are sequentially primary transferred onto the intermediate transfer belt 7 by the primary transfer rollers 5*a*, 5*b*, 5*c*, and 5*d*. In this manner, the four color toner images are superposed on the intermediate transfer belt 7. Toner which was not transferred on the intermediate transfer belt 7 and remains on the photosensitive drums 1*a* to 1*d* (residual toner) at the time of primary transfer is removed by drum cleaners 6*a*, 6*b*, 6*c*, 6*d*. The photosensitive drums 1*a* to 1*d* from which residual toner is removed is used for a next image forming process.

Transfer materials P conveyed by the convey apparatus from the sheet cassette 10 are supplied to the secondary transfer nip T2 in synchronization with toner image on the intermediate transfer belt 7 by registration rollers. Four color toner images on the intermediate transfer belt 7 are collectively secondary transferred to the supplied transfer materials P by the secondary transfer roller 9 in the secondary transfer nip T2.

The transfer material P on which the four color toner image is secondary transferred is conveyed to a fixing apparatus 11 where the transfer material P is heated and pressurized and a toner image is fixed to a surface of the transfer material P. The transfer material P to which the toner image is fixed is discharged onto a discharge tray. With this, a four color full-color image forming process on one surface (surface) of one transfer material P is completed.

(Development Apparatus 4)

The development apparatus 4 will be described in detail using FIG. 2. Since the development apparatuses used in the image forming apparatus main body of this embodiment have the same structures, only one of the development apparatuses will be described. In the following explanation, the development apparatus 4 may be any of the development apparatuses 4*a*, 4*b*, 4*c*, and 4*d*.

Figure 2:
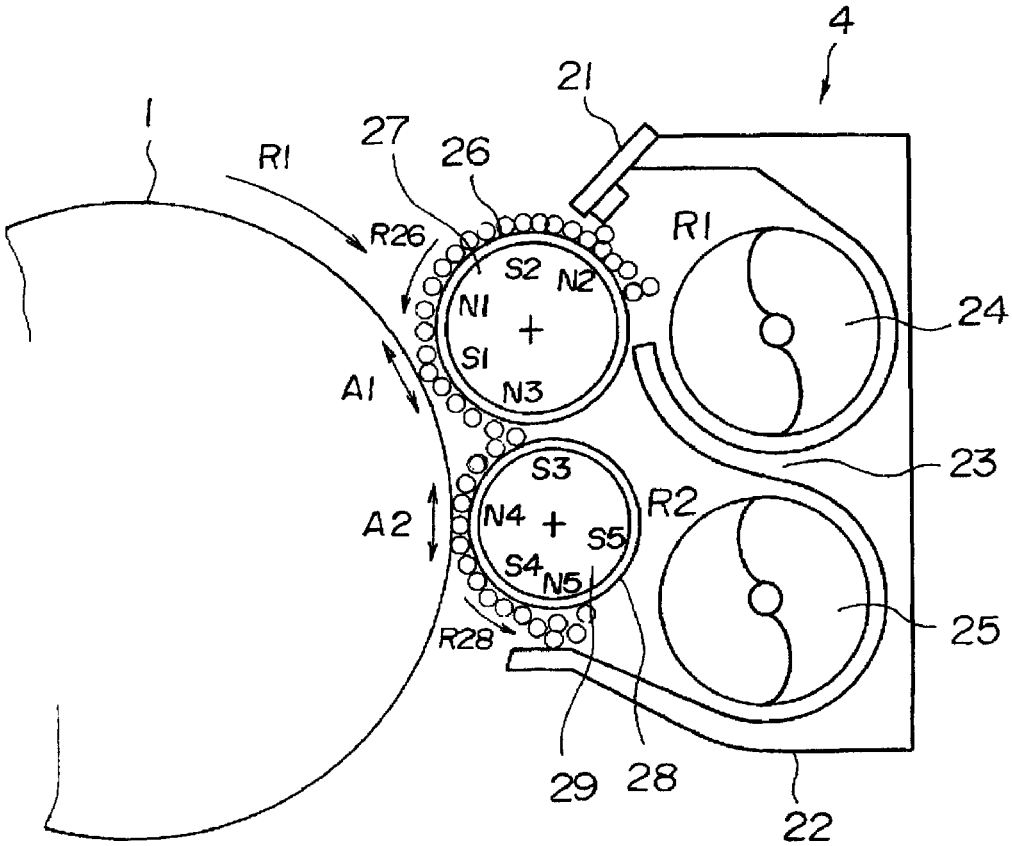
FIG. 2 is a diagram illustrating a structure of a development apparatus.

FIG. 2 illustrates a structure of the development apparatus 4. As shown in FIG. 2, the development apparatus 4 includes a developer container 22, a dividing wall 23, convey screws 24 and 25 and developing sleeves 26 and 28.

The interior of the developer container 22 is divided into a developing chamber R1 and a stirring chamber R2 by the dividing wall 23. Developer in which toner particles and magnetic carriers are mixed is accommodated in the developing chamber R1 and the stirring chamber R2. Resin magnetic carriers are used as the magnetic carriers. The resin magnetic carrier comprises ferrite carrier, binder resin, magnetic metal oxide or non-magnetic metal oxide.

A convey screw 24 is accommodated in the developing chamber R1. The developer is conveyed along the longitudinal direction of the developing sleeves 26 and 28 by rotating and driving operations. A developer conveying direction formed by a screw 25 accommodated in the stirring chamber R2 is opposite from a developer conveying direction formed by a screw 24.

The dividing wall 23 is provided at its front side and deep side (both ends of the development apparatus in the longitudinal direction) with openings. Developer conveyed by the screw 24 is delivered to the screw 25 through one of the openings, and developer conveyed by the screw 25 is delivered to the screw 24 through the other opening.

An opening is provided in a portion of the developer container 22 closer to the photosensitive drum 1, and two developing sleeves, i.e., a first developer bearing member (upstream developing sleeve 26) and a second developer bearing member (downstream developing sleeve 28) having adequate irregularities on the surfaces thereof are provided at the opening. Each of the developing sleeves 26 and 28 has 1 mm thickness, 30 mm outer diameter and 350 mm length in the thrust direction. The developing sleeves 26 and 28 are opposed to the photosensitive drum 1 at a fine gap of 300 μm.

The upstream developing sleeve 26 which is the first developer bearing member rotates in the direction of the arrow R26 (opposite to the direction from the rotation direction of the photosensitive member). The thickness of upstream developing sleeve 26 is restricted to an appropriate developer layer thickness by a layer thickness restriction blade (layer thickness restriction member) 21 located at an upper end of the opening of the developing container and then, the upstream developing sleeve 26 carries and conveys the developer to the first developing region A1. A roller-shaped first magnet roller 27 is fixed and disposed in the upstream developing sleeve 26. The layer thickness restriction blade 21 is disposed at a predetermined gap from the upstream developing sleeve 26.

The first magnet roller 27 includes a developing magnetic pole S1 which is opposed to the first developing region A1. An ear of magnetic developer by a developing magnetic field formed in the first developing region A1, and a magnetic brush of developer is formed. The magnetic brush comes into contact with the photosensitive drum 1 which rotates in the direction of the arrow a in the first developing region A1, and an electrostatic image is developed in the first developing region A1. At that time, toner which is an ear of magnetic developer to the magnetic brush and toner which is an ear of magnetic developer to the surface of the developing sleeve are transferred to an image region of the electrostatic image for developing.

In this embodiment, the first magnet roller 27 includes poles N1, N2, N3 and S2, in addition to the developing magnetic pole S1. The poles N3 and N2 are the same polarities and adjacent to each other, and repulsion magnetic field is formed. Therefore, a barrier is formed against developer.

The downstream developing sleeve 28 which is the second developer bearing means is disposed in a region substantially opposed to both the upstream developing sleeve 26 and the photosensitive drum 1 such that the developing sleeve 28 can rotate in the direction of the arrow R28. The downstream developing sleeve 28 comprises non-magnetic material like the upstream developing sleeve 26, and a roller-like second magnet roller 29 which is magnetic field generating means is disposed in the downstream developing sleeve 28 in a state where the second magnet roller 29 does not rotate.

The second magnet roller 29 includes five poles, i.e., magnetic poles S3, N4, S4, N5 and S5. A magnetic brush on the pole N4 is in contact with the photosensitive drum 1 in a second developing region A2, and carries out a second developing operation for a photosensitive member after it passes the first developing region A1. The pole S3 and the pole S5 have the same polarities, a repulsion magnetic field is formed between the pole S3 and the pole S5, and a barrier is formed against developer. The pole S3 is opposed to the pole N3 of the first magnet roller 27 incorporated in the upstream developing sleeve 26 near a position where the sleeves 26 and 28 are closest to each other.

(Flow of Developer)

Figure 3:
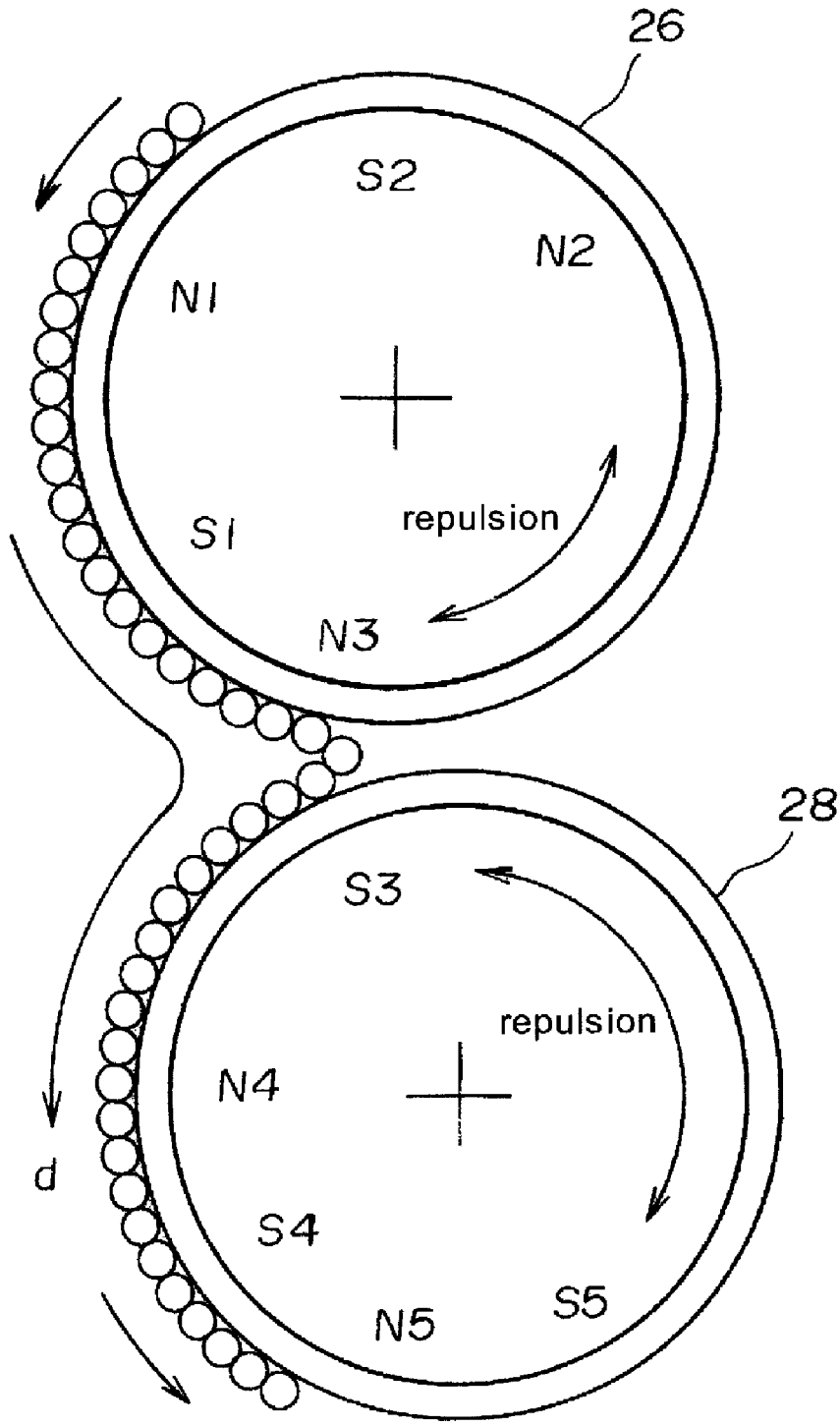
FIG. 3 is an explanatory diagram of flow of developer which is conveyed on a developing sleeve of the development apparatus.

Flow of developer will be described below. FIG. 3 is an enlarged view of the first developing sleeve 26 and the second developing sleeve 28. As shown in FIG. 3, a repulsion magnetic field is formed between the pole N3 and the pole N2 of the first developing sleeve (upstream developing sleeve) 26, and a repulsion magnetic field is formed between the pole S3 and the pole S5 of the second developing sleeve (downstream developing sleeve) 28. The pole N3 is located at a position upstream from the position where the sleeves 26 and 28 are closest to each other in the rotation direction of the developing sleeve 26.

Therefore, developer which was conveyed over the upstream developing sleeve 26 and passed through the first developing region A1 reaches the pole N3. The developer moves toward the downstream developing sleeve 28 in accordance with magnetic lines of force extending from the pole N3 to the pole S3 as shown with the arrow d, and the developer is conveyed to the convey screw 25 in the stirring chamber R2 by the downstream developing sleeve 28.

That is, the developer is conveyed through N2→S2→N1→S1→N3 of the upstream developing sleeve 26 and then, blocked by a repulsion magnetic field of the upstream developing sleeve 26 at the pole N3, and is moved to the downstream developing sleeve 28. Then, the developer is conveyed through S3→N4→S4→N5→S5 of the downstream developing sleeve 28, blocked by a repulsion magnetic field of the downstream developing sleeve 28 at the pole S5, and is peeled off into the stirring chamber R2.

It is not necessary that the pole N3 and the pole S3 which are delivery poles (delivery portions) are completely opposed to each other. If pole N3 is in a deviation range of 45° toward the upstream in the rotation direction of the developing sleeve 26 from the position where the poles are completely opposed to each other (position where they are closest to each other) and the pole S3 is substantially opposed to the pole N3, the developer can be delivered smoothly.

(Material of Developing Sleeves 26 and 28)

Materials of first and second base material constituting the developing sleeves 26 and 28 will be described.

Conventionally, non-magnetic stainless steel (SUS) or aluminum are frequently used as the material of the first and second base materials of the developing sleeves 26 and 28 in view of performance and cost. As described in the paragraph of problem to be solved by the invention, stainless steel has a problem that wear resistance is excellent but thermal distribution is not uniform and thus, stainless steel is easily deformed. Thermal distribution of aluminum is uniform and the aluminum is not easily deformed but aluminum has a problem that it can easily be shaved.

When non-magnetic stainless steel is actually used as the base material of the upstream developing sleeve 26 and the downstream developing sleeve 28, a problem that the sleeve is deformed by heat is caused in some cases if there is a heat source, such as, from fixing of photosensitive drum near the sleeve. When aluminum is used as the upstream developing sleeve 26 or the downstream developing sleeve 28, the desired lifetime was not obtained due to shaving in some cases.

In the development apparatus 4 of the embodiment, aluminum is used as the material of base material of the upstream developing sleeve 26 and stainless steel is used as the material of the base material of the downstream developing sleeve 28. The reason thereof will be described below.

Examples of the stainless steel mentioned here are SUS303, SUS304, SUS305 and SUS316 (see JIS G4303), and any of them may be used. In this embodiment, SUS305 was used because it has a weak magnetic force and it can be machined easily.

Here, aluminum is pure aluminum or an aluminum alloy. The aluminum alloy is an alloy having aluminum as a main component, and steel, manganese, silicon, magnesium, zinc or nickel is mixed, thereby enhancing characteristics as metal material such as strength.

When stainless steel is used as the material of the base material of the upstream developing sleeve 26 having the layer thickness restriction blade 21, if the upstream developing sleeve 26 is deformed due to uneven thermal distribution, a distance between the layer thickness restriction blade 21 and the developing sleeve 26 is periodically varied. Therefore, an amount of developer coated on the developing sleeve 26 is varied due to the rotation cycle of the upstream developing sleeve 26. As a result, density is varied.

Since the downstream developing sleeve 28 receives developer from the upstream developing sleeve 26, the downstream developing sleeve 28 does not have the layer thickness restriction blade 21. Therefore, even if the downstream developing sleeve 28 is deformed due to uneven thermal distribution, a variation in developer amount is not generated in the rotation cycle of the developing sleeve 28 unlike the upstream developing sleeve 26. Therefore, even if stainless steel is used as the material of the base material of the downstream developing sleeve 28, the effect of thermal deformation is small.

When aluminum is used as the material of the base material of the developing sleeves 26 and 28, the developing sleeves 26 and 28 are shaved in the delivery portion (poles N3 and S3) of developer from the upstream developing sleeve 26 to the downstream developing sleeve 28.

In the delivery portion (poles N3 and S3), it is necessary that the surface of the downstream developing sleeve 28 receives developer from the upstream developing sleeve 26 in a state where the surface of the downstream developing sleeve 28 rotates in a direction opposite to the direction of the flow of developer on the upstream developing sleeve 26. Therefore, sliding friction between the downstream developing sleeve 28 and the developer is large and the sleeve is easily shaved.

Since the upstream developing sleeve 26 only delivers the developer to the downstream developing sleeve 28, the sliding friction with respect to the developer is small. Therefore, even if aluminum is used as the material thereof, the effect of shaving is smaller unlike the downstream developing sleeve 28.

For the above reason, the upstream developing sleeve 26 is easily deformed thermally but is not shaved easily and thus, aluminum which has relatively high thermal conductivity and which is not easily deformed thermally can be used for the upstream developing sleeve 26. The downstream developing sleeve 28 is easily shaved but is not easily deformed by heat and thus, stainless steel having relatively excellent wear resistance may be used for the downstream developing sleeve 28.

(Experiment of Density Variation and Shaving)

In the development apparatus 4 of the embodiment, experiment of density variation and shaving caused by thermal deformation was carried out for comparative examples 1 and 2 and the example 1 while changing the material of the base material of the developing sleeve 26. Table 1 illustrates a result of the experiment. In the experiment, SUS305 was used as stainless steel and A5000-based aluminum alloy was used as aluminum.

In the comparative example 1, stainless steel was used for both the developing sleeves 26 and 28. In the comparative example 2, aluminum was used for both the developing sleeves 26 and 28. In the example 1, aluminum was used for the developing sleeve 26 and stainless steel was used for the developing sleeve 28.

Concerning the density variation caused by thermal deformation, presence or absence of generation of density variation was compared in rotation cycles of the developing sleeves 26 and 28 when the photosensitive drum 1 was maintained at 45° C. by a heater. Concerning the shaving of the developing sleeves 26 and 28, experiment corresponding to 500,000 sheets of paper was carried out, and shaved amounts of the developing sleeves 26 and 28 were compared with each other.

TABLE 1

| | Developing sleeve 26 | Developing sleeve 28 | Density variation | Shaved amount of developing sleeve 26 | Shaved amount of developing sleeve 28 |
|---|---|---|---|---|---|
| Comparative example 1 | Stainless steel | Stainless steel | X generated | ○ 2 μm | ○ 2 μm |
| Comparative example 2 | aluminum | aluminum | ○ not generated | ○ 2 μm | X 7 μm |
| Example 1 | aluminum | Stainless steel | ○ not generated | ○ 2 μm | ○ 2 μm |

As shown in Table 1, in the comparative example 1, density variation was generated, both the developing sleeves 26 and 28 were shaved at the initial stage by 2 μm but they were not shaved thereafter.

In the comparative example 2, a density variation was not generated, but a shaved amount of the downstream developing sleeve 28 was large (7 μm), conveying performance of developer was deteriorated and conveying failure of developer was generated. If conveying performance of only the downstream developing sleeve 28 was deteriorated, developer remains in the delivery portion (poles N3 and S3), a problem that an image on the photosensitive drum was scratched and carrier as an ear of magnetic developer to the photosensitive drum occurred.

In the example 1, density variation was not generated, both the developing sleeves 26 and 28 were shaved at the initial stage by 2 μm but they were not shaved thereafter, and a problem of shaving did not occur.

(Measurement of Temperature Distribution)

Concerning the comparative examples 1 and 2 and the example 1, temperature distribution of the developing sleeves 26 and 28 in the image forming apparatus was measured.

In the comparative examples 1 and 2 and the example 1, the temperature of the developing sleeve using stainless steel at the room temperature of 22° C. was about 43° C. at a position A (see FIG. 4) of the developing portion opposed to the photosensitive drum 1. The temperature of the developing sleeve was about 32° C. at the position B on the opposite side from the developing portion position A, and there was 11° C. temperature difference between the positions A and B.

In the comparative examples 1 and 2 and the example 1, the temperature of the developing sleeve using aluminum at a room temperature of 22° C. was about 43° C. at the position A (see FIG. 4) of the developing portion and the temperature of the developing sleeve at the position B was about 38° C., and there was 5° C. temperature difference between the positions A and B.

A difference caused by material of temperature difference between the positions A and B of the developing sleeves 26 and 28 can be explained well if the developing sleeve is regarded as a radiation fan.

Figure 4A:
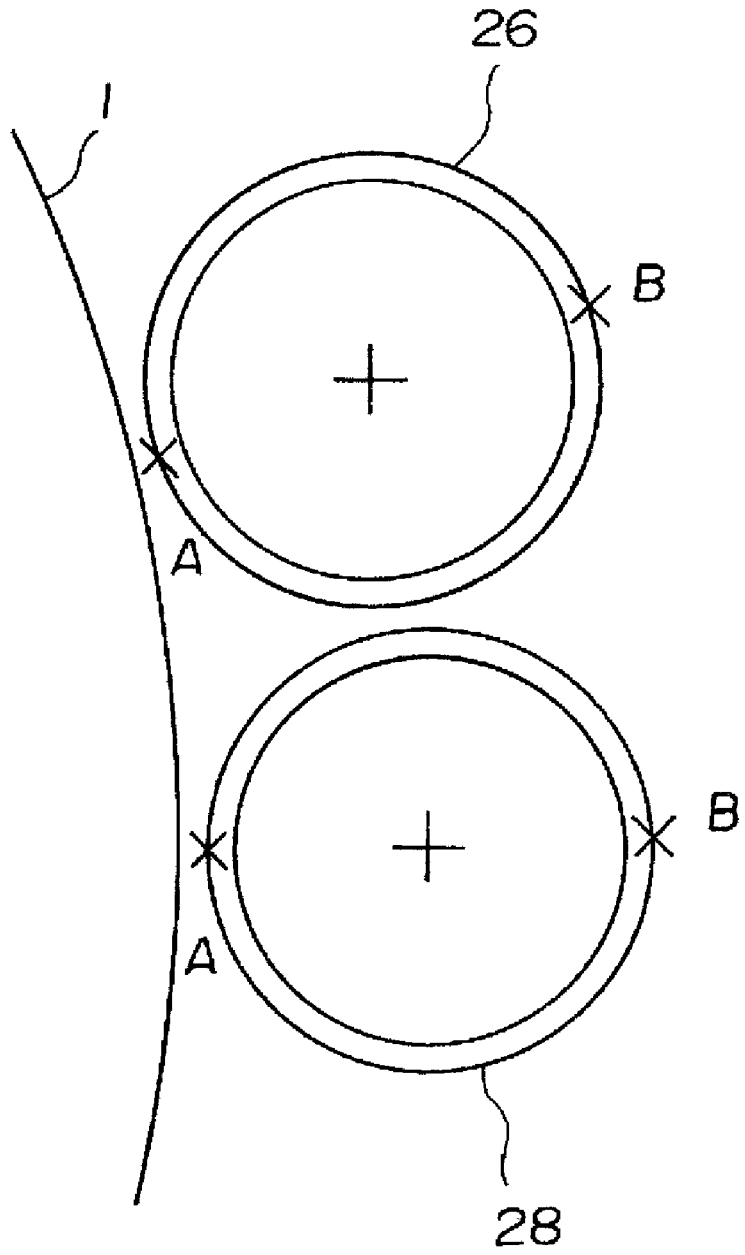
FIG. 4A is an explanatory diagram of measuring points A and B of temperature distribution of the development apparatus.
Figure 4B:
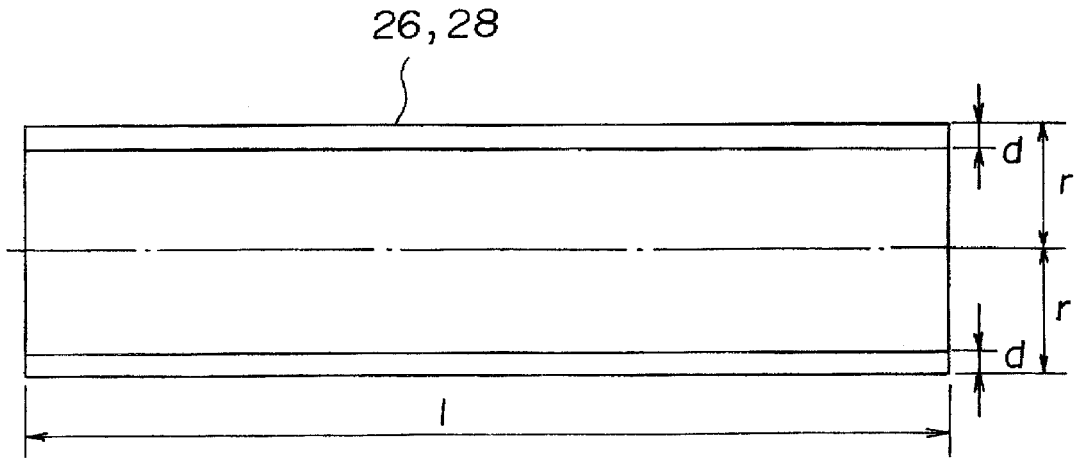
FIG. 4B is a diagram illustrating size of the developing sleeve in its longitudinal direction.

In FIG. 4A, when the position A of the developing portion of the cylindrical developing sleeves 26 and 28 is maintained at a temperature Ta=45° C., a temperature Tb of the opposite side position B is obtained by the following relationships. The temperature of the surrounding air is 22° C. FIG. 4B illustrates various sizes in the longitudinal direction of the developing sleeve.

$$\Delta Ta/\Delta Tb=\exp[-mx], \text{ and } m^2=hP/kA, \text{ where}$$

ΔTa: temperature difference between position A and atmosphere=Ta−Tair,

ΔTb: temperature difference between position B and atmosphere=Tb−Tair h: convection heat transmissibility (natural convection: coefficient indicative of effect of convection of air around the sleeve); 10 $W/m^2K$, k: thermal conductivity of base material of developing sleeve (stainless steel: 16 $W/m^2K$, aluminum: 200 $W/m^2K$), P: peripheral length of thickness cross section of base material of developing sleeve in the longitudinal direction=2×l+2×d≡(≈)0.7 m, l: length of base material of developing sleeve in the longitudinal direction (0.35 m), d: thickness of base material of developing sleeve ($0.7\times10^{-3}$ m), A: Cross-sectional area of thickness of base material in longitudinal direction=1×d=$2.45\times10^{-4}$ $m^2$, x: Distance L between A and B in sleeve outer peripheral surface=(peripheral length of outer periphery of developing sleeve)/2=π×r=$4.7\times10^{-2}$ m, r: Radius of developing sleeve (15 mm), Tair: Atmospheric temperature (22° C.), Ta: Temperature of position A (about 45°), Tb: temperature of position B According to the above equation, Tb (SUS) is 26° C. in the case of stainless steel, and Tb (aluminum) is 35° in the case of aluminum.

As described above, the above equation well expresses the difference of thermal distribution. If the developing sleeve is made of material having excellent thermal conductivity (aluminum), it can theoretically be found that temperature variation of the developing sleeve is improved.

There is a slight difference between the above calculation value and the actually measured value. This difference is generated because the temperature of air around the developing sleeves 26 and 28 becomes higher than peripheral air temperature 22° C. with temperature distribution due to heat of the photosensitive drum 1. To find a correct temperature, it, is necessary to precisely find the atmospheric temperature, but as long as attention is paid to the difference of temperature distribution, a precise value of atmospheric temperature is not important. The difference in temperature distribution is eliminated when an absolute value (mx) of multiplier of the right term of the above equation is 0, and the difference becomes smaller as the absolute value approaches 0. Therefore, if the material and shape of the developing sleeve is selected so that the absolute value of the multiplier becomes small, it is estimated that the thermal deformation is reduced.

(mx and presence and absence of generation density variation)

Concerning base materials of the following 16 kinds of developing sleeves, mx was calculated and presence and absence of generation of density variation was checked, and correlation thereof was checked.

Developing sleeves made of four kinds materials, i.e., stainless steel, iron, aluminum and copper are prepared. Developing sleeves having four different diameters (ϕ20 mm, ϕ25 mm, ϕ30 mm and ϕ40 mm) are prepared. The thickness of the developing sleeves is 1 mm and thrust length is 350 mm.

At that time, the atmospheric temperature was set to 15° C., and the heater temperature in the photosensitive drum was set to 50° C. Table 2 illustrates thermal conductivity of the materials (stainless steel, iron, aluminum and copper). Table 3 illustrates, at the same time, a calculation result of mx and presence and absence of generation of density variation. In table 3, ○ indicates that density variation is not generated, Δ indicates that a slight density variation is generated and x indicates that density variation is generated.

TABLE 2

| | Thermal conductivity |
|---|---|
| Stainless steel | 16 $W/m^2K$ |
| Iron | 83.5 $W/m^2K$ |
| Aluminum | 200 $W/m^2K$ |
| Copper | 400 $W/m^2K$ |

TABLE 3

| | Outer diameter ϕ20 | | Outer diameter ϕ25 | | Outer diameter ϕ30 | | Outer diameter ϕ40 | |
|---|---|---|---|---|---|---|---|---|
| | Density variation | mx | Density variation | mx | Density variation | mx | Density variation | mx |
| Stainless steel | X | 1.33 | X | 1.66 | X | 1.99 | X | 2.65 |
| Iron | ○ | 0.58 | ○ | 0.73 | Δ | 0.87 | X | 1.16 |

TABLE 3-continued

| | Outer diameter φ20 | | Outer diameter φ25 | | Outer diameter φ30 | | Outer diameter φ40 | |
|---|---|---|---|---|---|---|---|---|
| | Density variation | mx | Density variation | mx | Density variation | mx | Density variation | mx |
| Aluminum | ○ | 0.38 | ○ | 0.47 | ○ | 0.56 | ○ | 0.75 |
| Copper | ○ | 0.27 | ○ | 0.33 | ○ | 0.4 | ○ | 0.53 |

From these results, it was found that there is a correlation between the value of mx and presence and absence of generation of density variation, and if the value of mx was smaller than 1 (0<mx<1), it was possible to suppress the generation of density variation by thermal deformation.

(Material and Shaving)

The shaved amount of six materials (stainless steel, titanium alloy, gold-platinum alloy, iron, aluminum and copper) were checked. Developing sleeves made of the six kinds of materials were used in the development apparatus 4 of the embodiment, endurance tests corresponding to 500,000 sheets of paper and the shaved amount were compared with each other. Table 4 illustrates a result thereof and Vickers hardness at the same time.

From the result of the test, it can be found that there is a correlation between the shaved amount and the hardness, and if the Vickers hardness is high, material is less prone to be shaved. If the Vickers hardness is 280 Hv or higher, or more preferably 300 Hv or higher, it can be said that there is no problem concerning the shaved amount. Here, 2 μm shaving is a fine projection caused at the time of blast machining, and this is caused even if material is hard. This shaving does not affect the conveying performance.

As described above, this shaving is related to the downstream developing sleeve 28, and even if the upstream developing sleeve 26 is made of relatively soft material, such as copper and aluminum, the shaved amount is not serious.

TABLE 4

| | Shaved amount | Vickers hardness |
|---|---|---|
| Stainless steel | ◎ 2 μm | 300-800 Hv |
| Titanium | ○ 2.5 μm | 280 Hv |
| Gold-platinum alloy | Δ 3 μm | 230 Hv |
| Iron | X 5 μm | 140-150 Hv |
| Aluminum | X 7 μm | 100 Hv |
| Copper | X 8 μm | 60-70 Hv |

(Result)

From the above fact, since the upstream developing sleeve 26 having the developer restriction blade 21 is prone to be affected by thermal deformation, the strength against the thermal deformation is enhanced by selecting material and shape of the base material of the developing sleeve such that 0<mx<1 is satisfied. Since the downstream developing sleeve 28 is easily shaved, the wear resistance is enhanced by selecting a material having relatively excellent wear resistance in which Vickers hardness is 300 Hv or higher.

With this, in the development apparatus using two or more developing sleeves, it is possible to suppress the density variation by thermal deformation of uthe developing sleeve caused by uneven temperature distribution without deteriorating the durability of the developing sleeve, and to obtain high quality images having no density variation.

Examples of suitable material for the base material of the upstream developing sleeve 26 are pure aluminum and aluminum alloy. An example of suitable material for the downstream developing sleeve 28 is stainless steel (JIS G4303).

Concerning the developer, in this embodiment, only two-component developer comprising non-magnetic toner and magnetic carrier is described. However, the present invention is not limited to this developer, the invention can also be applied to a case in which magnetic particles are included in developer, such as a case in which magnetic toner is used and a case in which magnetic toner and magnetic carrier are used.

Second Embodiment

Figure 5:
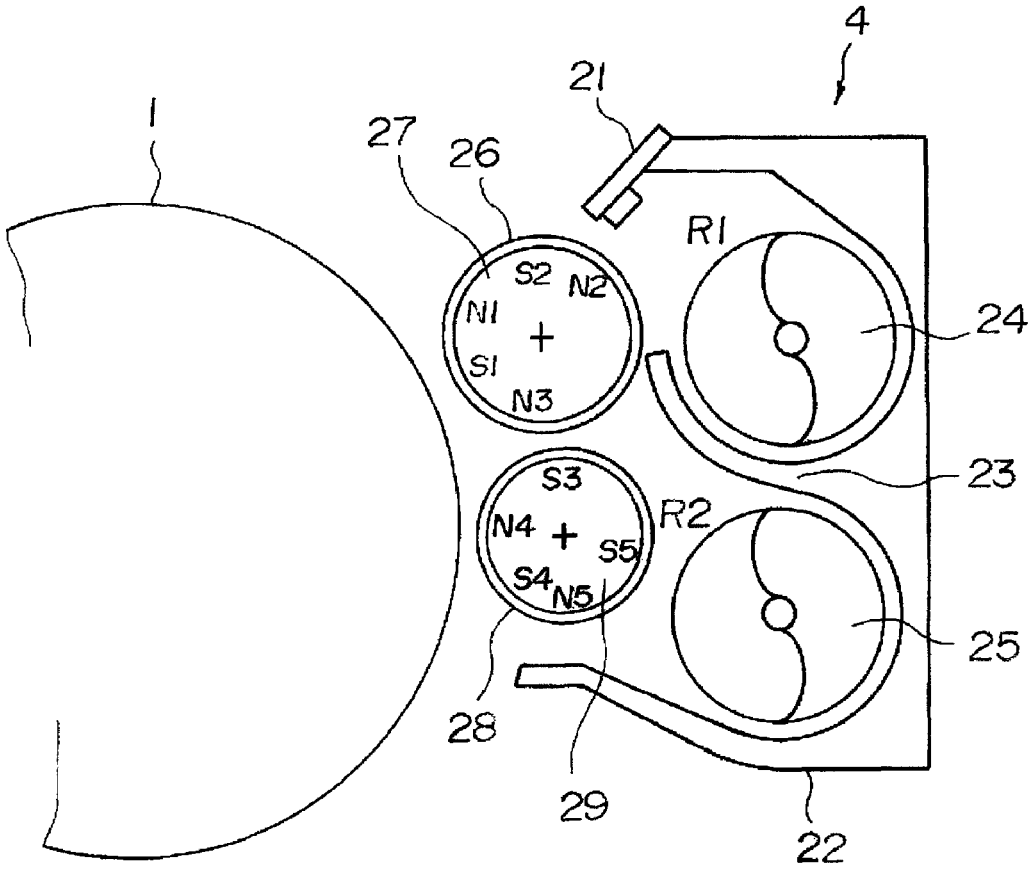
FIG. 5 is a diagram illustrating a structure of a development apparatus according to a second embodiment.

A second embodiment of the development apparatus of the present invention will be described next. FIG. 5 illustrates a structure of a development apparatus 4 of the embodiment. The same portions as those of the first embodiment are designated with the same reference numerals, and explanation thereof will be omitted.

As shown in FIG. 5, according to the development apparatus 4 of the second embodiment, in the development apparatus 4 of the first embodiment, an outer diameter of the second developing sleeve (developing sleeve 28) is smaller than that of the first developing sleeve (developing sleeve 26).

In view of wear resistance, the base material of the downstream developing sleeve 28 is stainless steel. Therefore, the downstream developing sleeve 28 is easily deformed by heat. However, since the downstream developing sleeve 28 does not have the restriction blade 21, the downstream developing sleeve 28 is not affected by thermal deformation, and there is no problem when it is actually used. However, it is preferable that it has such a structure that thermal deformation is not generated easily.

The outer diameters of the upstream developing sleeve 26 and the downstream developing sleeve 28 are the same in the first embodiment, but if the outer diameter is smaller, a difference in temperature distribution is less prone to be generated. Therefore, it is preferable that the downstream developing sleeve 28 having no suppressing effect of thermal deformation by the material has a smaller outer diameter than that of the upstream developing sleeve 26.

Since the developing nip becomes smaller if the outer diameters of both the upstream developing sleeve 26 and downstream developing sleeve 28 are reduced, a problem that the developing performance is deteriorated occurs in some cases. Therefore, it is necessary that the outer diameter of the upstream developing sleeve 26 in which thermal conductivity is relatively high and thermal deformation is less prone to be generated is greater and the outer diameter of the downstream developing sleeve 28 in which the thermal conductivity is relatively low and thermal deformation is prone to be generated is smaller.

In this embodiment, the outer diameter of the upstream developing sleeve 26 is 30 mm and the outer diameter of the downstream developing sleeve 28 is 20 mm.

According to the above-described structure, the same effect as that of the first embodiment can be obtained, and temperature distribution is less prone to be generated in the downstream developing sleeve 28.

Third Embodiment

Figure 6:
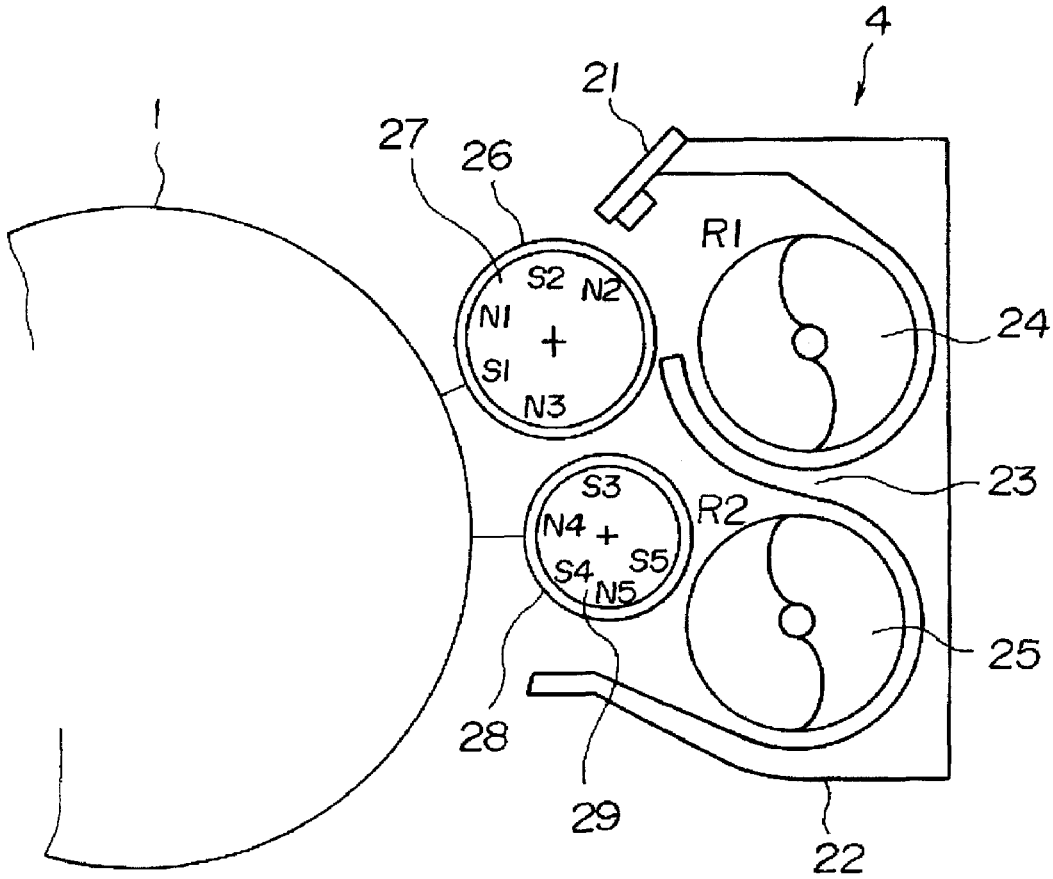
FIG. 6 is a diagram illustrating a structure of a development apparatus according to a third embodiment.

A third embodiment of the development apparatus of the present invention will be described next. FIG. 6 illustrates a structure of a development apparatus 4 of the embodiment. The same portions as those of the first and second embodiments are designated with the same reference numerals, and explanation thereof will be omitted.

Concerning the heat source which may cause thermal deformation of the developing sleeve, a photosensitive drum 1 having a heater therein and a fixing apparatus can be conceived. As a countermeasure for this, it is conceived that the developing sleeve is separated away from the heat source as much as possible.

However, concerning the photosensitive drum 1 having a heater therein, if a distance between the photosensitive drum 1 and the developing sleeves 26 and 28 is too long, a problem that the developing performance is deteriorated occurs. Therefore, the distance cannot exceed a certain level. The distance mentioned here is the shortest distance between the surface of the photosensitive drum 1 and the surfaces of the developing sleeves 26 and 28.

As described in the second embodiment also, the downstream developing sleeve 28 in which thermal conductivity is relatively low and thermal deformation is prone to be generated has such a structure that the downstream developing sleeve 28 is less prone to be deformed by heat. Hence, in this embodiment, as shown in FIG. 6, a distance between the downstream developing sleeve 28 and the photosensitive drum 1 is longer than a distance between the upstream developing sleeve 26 and the photosensitive drum 1. More specifically, the distance between the upstream developing sleeve 26 and the photosensitive drum 1 is 250 μm, and the distance between the downstream developing sleeve 28 and the photosensitive drum 1 is 400 μm.

With this structure, the effect of the first or second embodiment can be obtained, and the downstream developing sleeve 28 is less prone to be deformed by heat.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from the prior Japanese Patent Application No. 2007-018723 filed on Jan. 30, 2007 the entire contents of which are incorporated by reference herein.

What is claimed is:

1. A development apparatus which develops, using a developer, an electrostatic image borne by an image bearing member, comprising:

a first member which bears and conveys the developer to a first developing region opposed to the image bearing member, which develops the electrostatic image in the first developing region;

a restriction member which restricts a layer thickness of the developer carried by the first member; and a second member which bears and conveys the developer received from the first member to a second developing region opposed to the image bearing member, which develops the electrostatic image in the second developing region, wherein the first member is made of one of pure aluminum and an aluminum alloy and the second member is made of stainless steel, and wherein the second member has Vickers hardness of 300 Hv or higher, and the first member satisfies the following relationships:

$0<mx<1$ and $m^2=(hP)/(kA)$, where h is a convection heat transmissibility (natural convection) ($W/m^2K$), k is a thermal conductivity of a material of which the first member is made ($W/m^2K$), P is a peripheral length of a cross-sectional area of the first member in the longitudinal direction (m), A is a cross-sectional area of the first member in the longitudinal direction ($m^2$), and x is a peripheral length of an outer periphery of the first member/2 (m).

2. The development apparatus according to claim 1, wherein an outer diameter of the second member is smaller than an outer diameter of the first member.

3. The development apparatus according to claim 1, wherein the shortest distance between the second member and the image bearing member is longer than the shortest distance between the first member and the image bearing member.

* * * * *